US005387043A

United States Patent [19]

Fujioka et al.

[11] Patent Number: 5,387,043

[45] Date of Patent: Feb. 7, 1995

[54] COMPACT PRINTER

[75] Inventors: Satoshi Fujioka; Masayuki Ono, both of Suwa, Japan

[73] Assignee: Seiko Epson Corporation, Tokyo, Japan

[21] Appl. No.: 85,710

[22] Filed: Jun. 30, 1993

[30] Foreign Application Priority Data

Jul. 1, 1992 [JP] Japan ..... 4-197581
Sep. 3, 1992 [JP] Japan ..... 4-263196

[51] Int. Cl.[6] ..... B41J 29/06

[52] U.S. Cl. ..... 400/691; 400/625

[58] Field of Search ..... 400/88, 680, 681, 685, 400/686, 691, 692, 693, 694, 625; 312/208.1, 208.2, 208.3, 208.4

[56] References Cited

FOREIGN PATENT DOCUMENTS 0418793 3/1991 European Pat. Off. .
0418822 3/1991 European Pat. Off. .
0451828 10/1991 European Pat. Off. .
0489926 6/1992 European Pat. Off. .
0540301 5/1993 European Pat. Off. .
62-73972 4/1987 Japan .
5008503 1/1993 Japan ..... 400/691
2235904 3/1991 United Kingdom .

*Primary Examiner*—Ren Yan
*Attorney, Agent, or Firm*—Stroock & Stroock & Lavan

[57] ABSTRACT

In a compact printer, a stand and stack member is rotatably and slidably mounted on the rear end face of the printer body having a sheet discharging outlet near the rear edge of the upper surface thereof, a sheet feeding tray for accommodating a plurality of recording sheets is provided on the bottom of the printer body in such a manner that the sheet feeding tray forms a part of the bottom of the printer body, and is operable to open and close. Therefore, the printer can be set flat or upright depending on the purpose of use, and is convenient to transport.

14 Claims, 4 Drawing Sheets

COMPACT PRINTER

BACKGROUND OF THE INVENTION

The present invention relates to a compact printer, and more particularly to a compact printer of a multipose type which can change in shape and in posture according to the purposes of use.

Where, in a printer, a space for accommodating recording sheets and a space for receiving recording sheets discharged from the printer are taken into consideration, and in addition where the convenience in space for the printer while not in use is also taken into consideration, the space occupied by the printer should be as small as possible. In this context, in view of the operating efficiency of the printer, it is preferable that a sheet accommodating space is provided in a lower room of the printer, and recording sheets supplied into the printer body from the sheet accommodating space are discharged from the rear end of an upper surface of the printer. Furthermore, it is desirable that the printer is so designed that its posture can be changed depending on the place where it is to be set; that the printer can be set not only flat but also upright.

However, the printer thus formed is disadvantageous in the following points: That is, when the printer is set flat, the recording sheets discharged upwardly from it may be scattered before and behind, and it is rather troublesome to rearrange them. On the other hand, in the case where the printer is set upright, the printer may fall down because of the weight of the recording sheets accommodated therein.

Those difficulties may be eliminated by additionally providing a discharged sheet receiving tray, and a supporting stand. However, the provisions of those additional components raises another problem. In transportation of the printer, those components may be rather troublesome to handle. In addition, when the printer is set flat, the supporting stand is not used, and when it is set upright, the tray is not used. Therefore, those components are liable to be lost.

Unexamined Japanese Patent Application (OPI) No. Hei. 3-101946 has disclosed a printer which can be set not only flat as shown in FIG. 7 but also upright as shown in FIG. 8. In the printer, a printer body 100 has no automatic sheet feeding tray. Therefore, in the case where the printer is set flat as shown in FIG. 7, a sheet supplying guide 102 is used to manually supply recording sheets S one at a time. In the case where the printer is set upright as shown in FIG. 8, an automatic sheet feeding device 200 must be coupled to the printer body 100. In addition, Unexamined Japanese Patent Application (OPI) No. Hei. 3-102028 has also disclosed a printer which can be set both flat and upright. However, its body has no automatic sheet feeding tray.

SUMMARY OF THE INVENTION

Accordingly, an object of the present invention is to eliminate the above-described difficulties accompanying conventional compact printers.

More specifically, an object of the invention is to provide a compact printer which capable of changing its shape and posture depending on the purposes of use by suitably displacing components built in it.

The foregoing and other objects of the invention have been achieved by the provision of a compact printer which, according to the invention, comprises: a printer body having a sheet discharging outlet near the rear edge of the upper surface thereof; and a stand and stack member rotatably and slidably mounted on the rear end face of the printer body, the stand and stack member being able to take an accommodating position so as to be accommodated in the rear end face, and a stack position to receive a recording sheet discharged through the sheet discharging outlet, and the stand and stack member serving as a stand for preventing the fall of the printer body when, with the stand and stack member raised on the side of the upper surface of the printer body, the printer body is set upright so that the printer body stands on the rear end face thereof.

Preferably a recess for accommodating the stand and stack member is formed in the rear end face of the printer body.

In the compact printer, a sheet feeding tray for accommodating a plurality of recording sheets is provided on the bottom of the printer body in such a manner that the sheet feeding tray, forming a part of the bottom of the printer body, is operable to open and close.

Preferably the sheet feeding tray is swingable about the shaft of a sheet feeding roller arranged in the printer body, so as to open and close.

It is preferable that the stand and stack member can be raised on the side of the bottom of the printer body, and when, with the stand and stack member raised on the side of the bottom of the printer body, the printer is set upright so that the printer body stands on the rear end face thereof, and the sheet feeding tray is set open, the stand and stack member serves as a stand for preventing the falling of the printer body towards the side of the sheet feeding tray.

Desirably the compact printer includes a manual sheet inserting slit in the bottom of the printer body, through which a recording sheet is to be manually supplied, the slit being opened when the sheet feeding tray is set closed.

The nature, principle, and utility of the invention will be more clearly understood from the following detailed description of the invention when read in conjunction with the accompanying drawings.

DESCRIPTION OF THE PREFERRED EMBODIMENTS

One preferred embodiment of this invention will be described with reference to the accompanying drawings.

Figure 1:
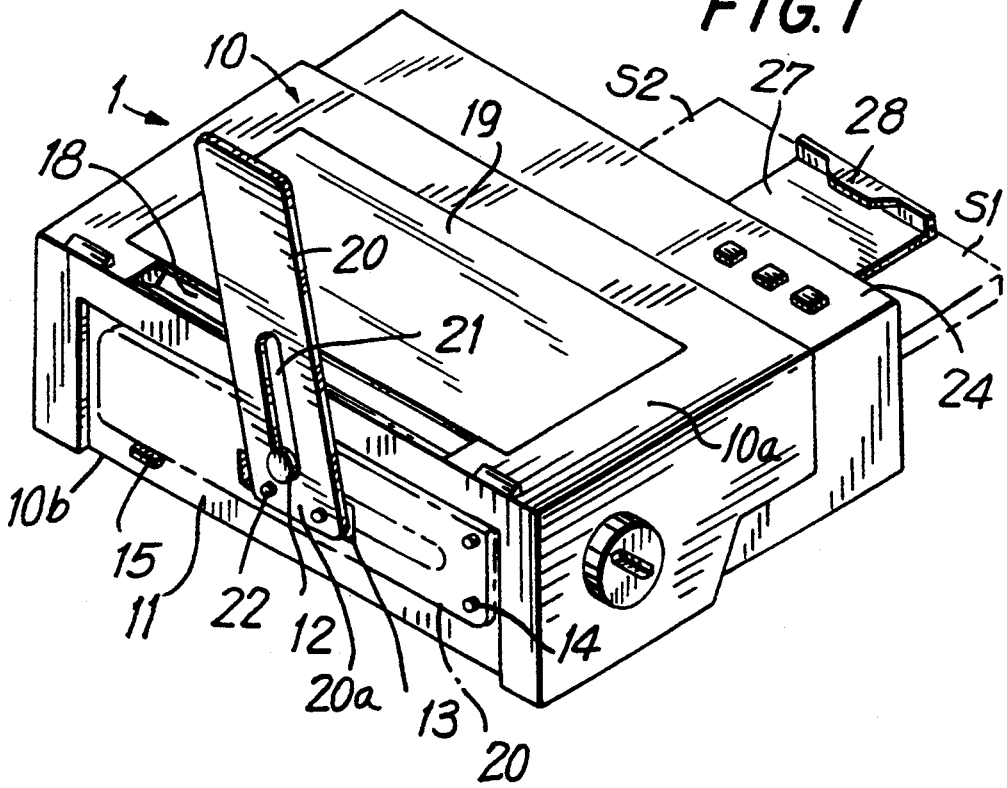
FIG. 1 is a perspective view of one example of a compact printer according to this invention, which is set flat.
Figure 2:
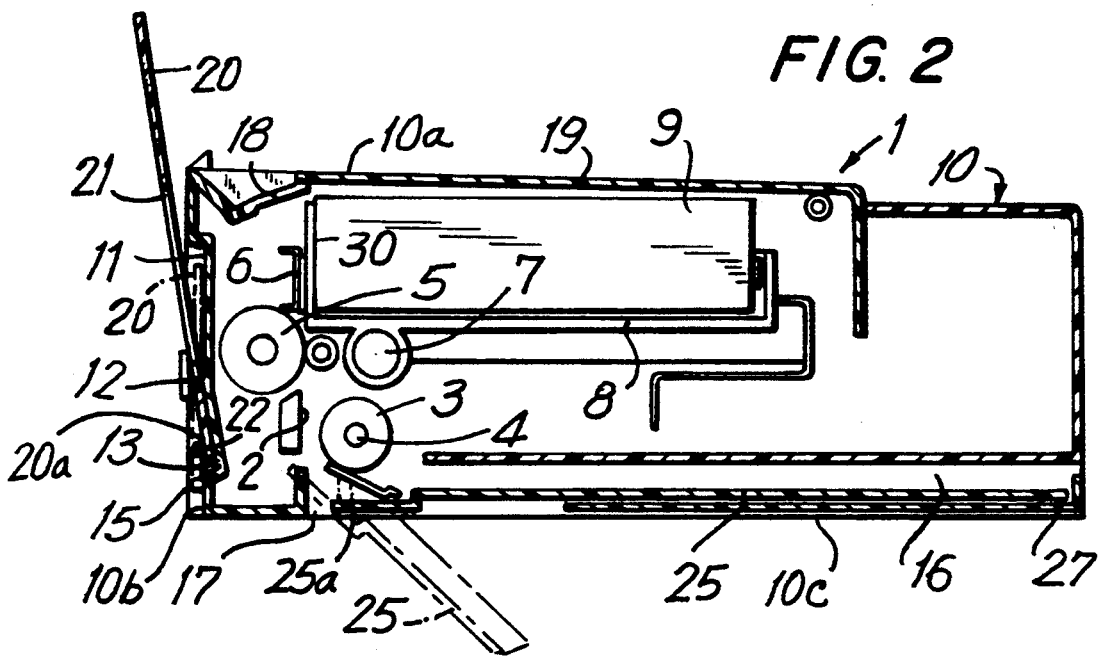
FIG. 2 is a sectional view of the compact printer shown in FIG. 1.

FIG. 1 is a perspective view showing one example of a compact printer according to the invention, which is set flat. FIG. 2 is a diagram showing the internal structure of the printer.

In FIGS. 1 and 2, reference numeral 1 designates a printer body; and 10, a casing. As shown in FIG. 2, a sheet conveying path 2 is formed in the back of the casing 10 (left in FIG. 2) in such a manner that it is extended vertically. In the sheet conveying path 2, a sheet feeding roller 3, a sheet feeding roller 5, and a paten 6 are arranged in the stated order in the sheet feeding direction.

Further in FIG. 2, reference numeral 8 designates a carriage confronted with the platen 6. The carriage 8 is reciprocated (in a direction perpendicular to the drawing surface of FIG. 2) while being guided by a carriage guide 7. A recording head 30 is mounted on the carriage 8, and it is used to print data on a recording sheet S (FIG. 1) through a recording ribbon which is supplied from a ribbon case 9. A plurality of recording sheets S have been stacked on a sheet feeding tray 25 which is set in the printer body 1 in such a manner that it can be removed therefrom when necessary. The recording sheets S thus stacked are pulled out of the sheet feeding tray by the sheet feeding roller 3 one at a time. The recording sheet S thus pulled out is fed by the sheet feeding roller 5 into the space between the platen 6 and the recording head 30.

The casing 10 is in the form of a relatively flat box having a width slightly larger than the width of a A4 size sheet. The casing 10 has a sheet discharging outlet 18 near the rear end of its upper surface 10*a*.

A board accommodating recess 11 is formed in the rear end face 10*b* of the casing 10, to accommodate a stand and stack board 20. More specifically, the board accommodating recess 11 is an elongated shallow recess which is extended in the direction of width of the casing 10 (or in a direction perpendicular to the drawing surface of FIG. 2) in such a manner as to cover the width substantially.

Figure 4:
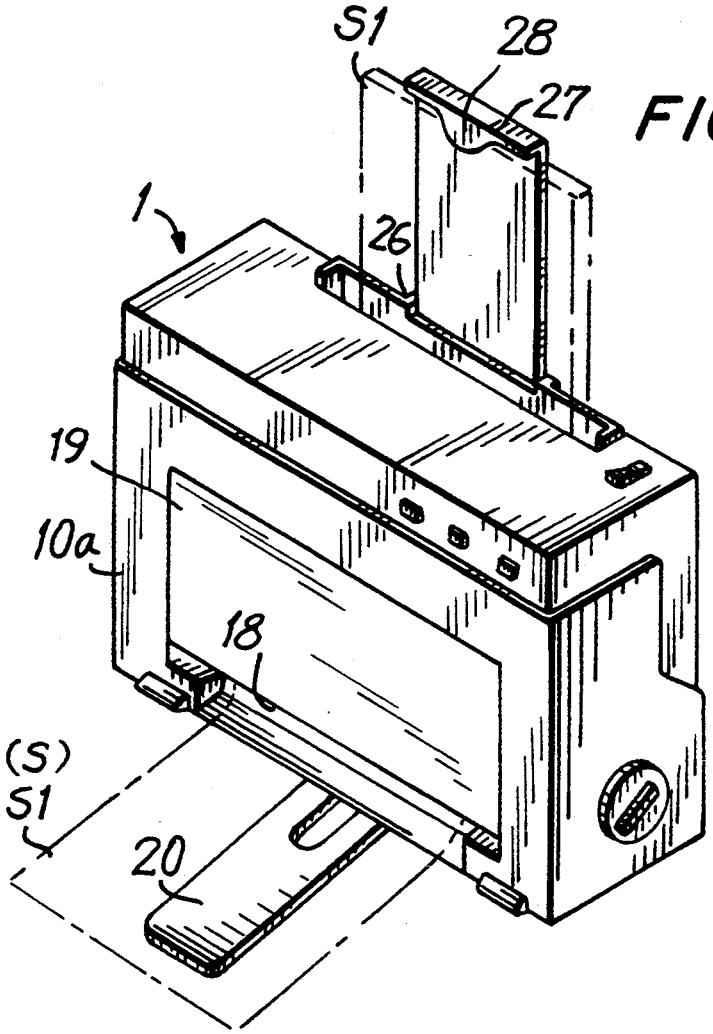
FIG. 4 is a perspective view of the compact printer which is set upright with a sheet feeding tray set closed.
Figure 5:
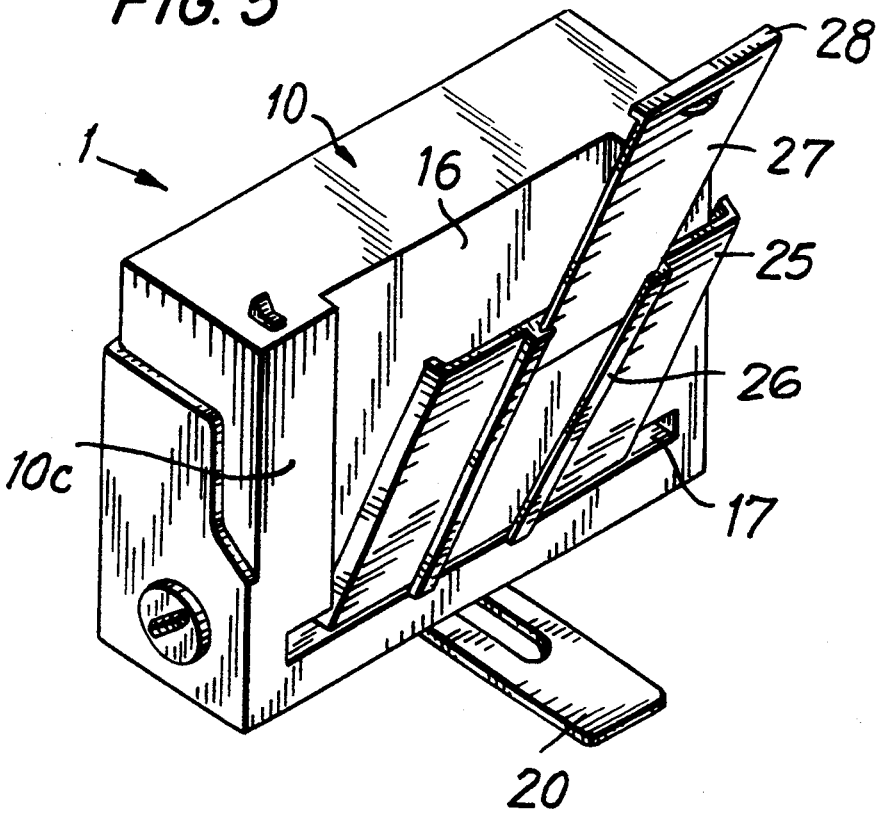
FIG. 5 is a perspective view of the compact printer which is set upright with the sheet feeding tray set open.
Figure 6:
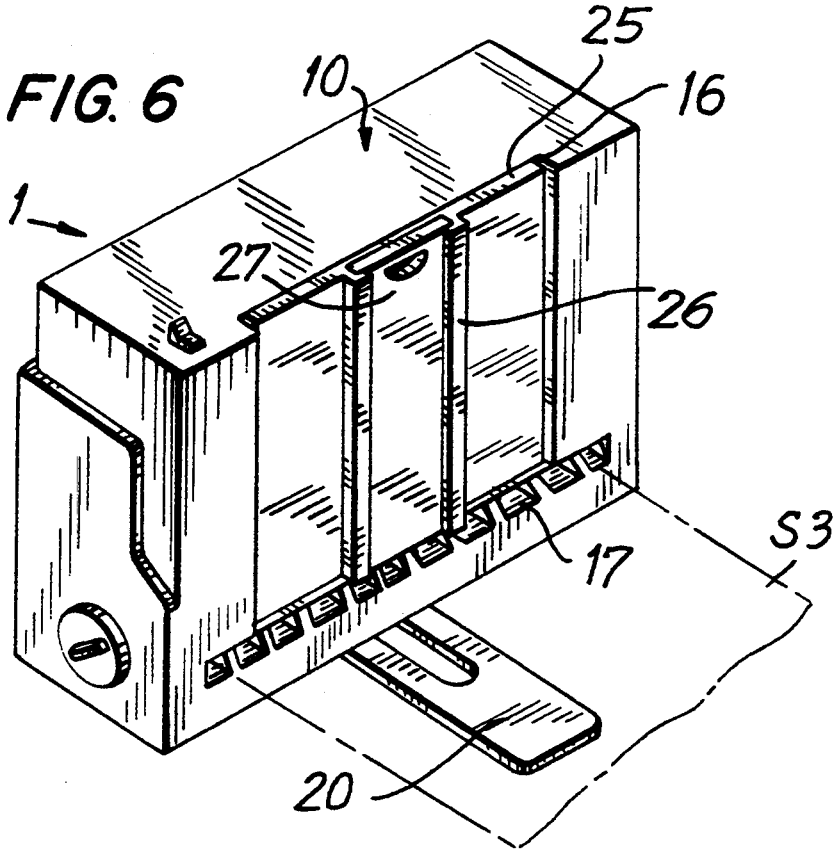
FIG. 6 is a perspective view of the compact printer for a description of the use of a manual sheet inserting slit.
Figure 8:
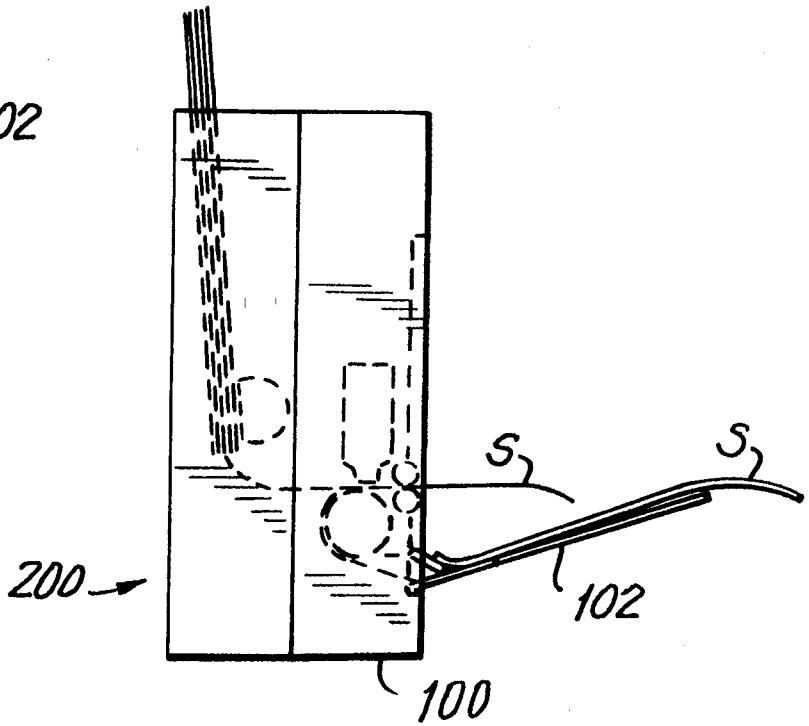
FIG. 8 PRIOR ART
FIGS. 7 and 8 are diagrams for a description of a conventional compact printer.
Figure 7:
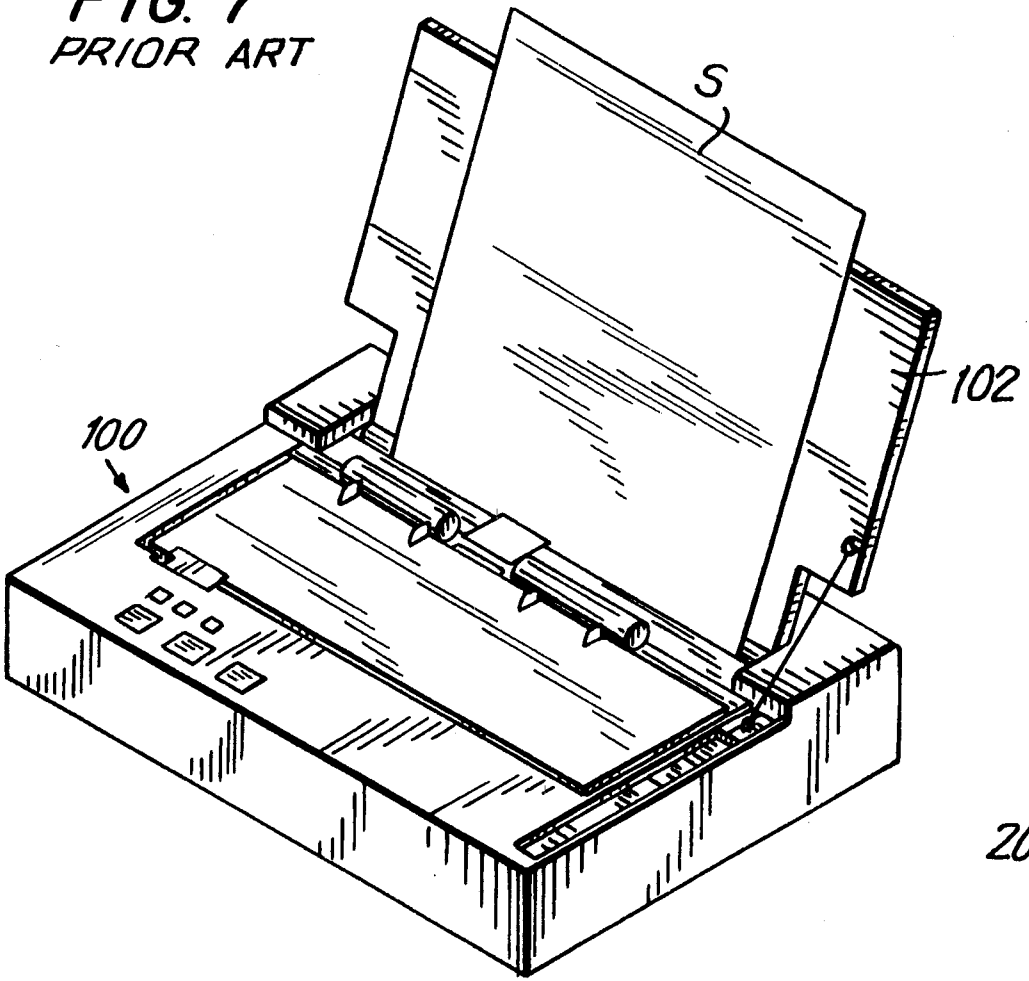
FIG. 7 PRIOR ART

The stand and stack board 20 is used as follows: When the printer body 1 is set flat as shown in FIG. 1; the board 20 is raised above the upper surface 10*a* so as to receive a recording sheet S discharged through the sheet discharging outlet 18. Furthermore, when the printer body 1 is set upright as shown in FIGS. 4 through 6, it is allowed to extend perpendicular to the upper surface or the bottom surface depending on the state of the sheet feeding tray 25, thereby to prevent the fall of the printer body. The board 20, as shown in FIG. 1, has an elongated hole 21 which is extended from the base end portion 20*a* to the middle of the board 20. The board 20 is slidably and rotatably engaged with a supporting stud 12 through the elongated hole 21.

The aforementioned supporting stud 12 is provided in the board accommodating recess 11 at the center which is adapted to receive the board 20 as was described above. In the board accommodating recess 11, an inclining recess 13 is formed below the supporting stud 12. The inclining recess 13 is deeper towards the lower edge, thus being triangular in section. The inclining recess 13 is used as follows: The base end portion 20*a* of the board 20 is inserted into the inclining recess 13, to hold the board 20 in such a manner that the latter 20 is inclined backwardly.

As shown best in FIG. 5, a tray accommodating recess 16 is formed in the bottom 10*c* of the casing 10, so as to accommodate the sheet feeding tray 25. The tray accommodating recess 16 is a shallow recess which is extended in the longitudinal direction of the casing 10 in such a manner as to cover the length of the latter 10 substantially. The rear edge of the tray accommodating recess 16 (the lower edge in FIG. 5) merges with a manual sheet inserting slit 17 which is extended in the direction of width of the casing 10 in such a manner as to cover the width substantially. The manual sheet inserting slit 17 is used when it is required to manually insert a recording sheet into the printer. Near the junction of the slit 17 and the tray accommodating recess 16, the aforementioned sheet feeding tray 25 is mounted in such a manner that it can be swung about the shaft 4 of the sheet feeding roller 3 to open halfway with the end portion 25*a* in the slit 17 (cf. FIG. 2).

As shown in FIG. 5, the sheet feeding tray 25 has two guides 26 on the bottom, with which a sub-tray 27 is engaged in such manner that it can be moved in and out. The sub-tray 27 has a bent portion 28 which is formed along the front edge to support the rear edges S1 of the recording sheets S stacked on the sheet feeding tray 25 (cf. FIG. 4).

In FIG. 1, reference numeral 14 designates a dowel pin which is engaged with a locking hole of the board 20, to lock the latter 20 at an accommodating position (indicated by the two-dot chain line in FIG. 1); 15, a protruded stopper for positioning the board 20 at the accommodating position; 19, a cover for the upper surface of the printer body 1; and 24, an operating panel.

Figure 3:
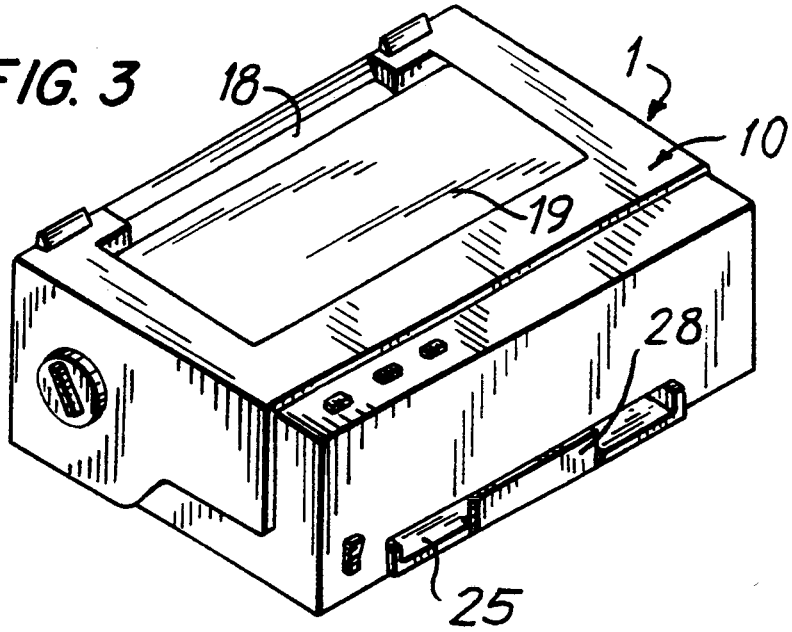
FIG. 3 is a perspective view of the compact printer with its stand and stack member accommodated therein.

In the case where the printer constructed as described above is not used, or transported, the sheet feeding tray 25 is accommodated in the tray accommodating recess 16 as shown in FIG. 3, and the stand and stack board 20 is turned until it is parallel with the board accommodating recess 11, and positioned therein with the aid of the dowel pin 14 and the stopper 15.

In the case where the printer is set flat, as shown in FIGS. 1 and 2 the board 20 is turned through 90° from its accommodating position (indicated by the two-dot chain lines) so that it is held upright.

In this operation, the base end portion 20*a* of the board 20 is inserted into the inclining recess (triangular in section) 13, so that the board 20 is held inclined backwardly. In a recording operation with the board 20 held this way, a recording sheet is discharged upwardly through the sheet discharging outlet 18, and placed on the board 20 as it is.

Recording sheets of A4 size or smaller are stacked on the sheet feeding tray 25, which is set in the tray accommodating recess 16 formed in the bottom of the printer body 1. On the other hand, recording sheets of B4 or larger are stacked as follows: As shown in FIG. 1, the sub-tray 27 is pulled out according to the size of the recording sheets so as to support the rear end portions S1 of the recording sheets which stick out of the sheet feeding tray 25.

On the other hand, in the case where the printer is to be set upright with the sheet feeding tray 25 closed, the printer body 1 is set upright with the board 20 raised on the side of the upper surface 10*a* of the printer body 1. Under this condition, a recording operation is carried out. In this operation, recording sheets S1 (or S) are successively discharged through the sheet discharging outlet 18 located at the lower edge of the upper surface, and stacked on the stand and stack board 20.

In the case when, as shown in FIG. 5, the board 20 is raised on the side of the bottom 10*c* of the printer body 1, the latter 1 is prevented from falling in this direction. Hence, when necessary, recording sheets S may be loaded with the sheet feeding tray 25 opened halfway. In this case, since the sheet feeding tray 25 is opened, the recording sheets S are taken into the sheet conveying path 2 while forming a relatively large angle with it; that is, they are fed smoothly.

In printing data on heavy recording sheets such as post cards, the printer is set upright, and the recording sheets are manually inserted through the manual sheet inserting slit 17 while being held horizontal, which is located at the lower edge of the rear surface. In this case, the recording sheets are delivered along the sheet conveying path straightly to the platen 6. Similarly, in the case where a recording sheet such as an A4 size recording sheet should be set horizontally long in the printer, it (S3) can be supplied into the slit 17 which is extended substantially all the way across the casing 10.

As was described above, in the printer of the invention, the printer body has the sheet feeding tray as a part of the bottom, and the stand and stack board which can be set selectively at the accommodating position, the printer body supporting position, and the sheet receiving position is proved on the rear end face of the printer body, and the sheet feeding tray is swingably mounted on the bottom of the printer body with the sheet feeding part as a fulcrum in such a manner that the sheet feeding tray is swung to open and close the bottom of the printer body. Hence, when the stand and stack member (board) is set at the accommodating position with the sheet feeding tray set closed, then the printer will be handy to transport, and free from the loss of its components. When the stand and stack member is set at the sheet receiving position, the printer body can be set flat for a printing operation. When the stand and stack member is set at the printer body supporting position, then the printer can be set upright for a printing operation.

When the printer body is set upright, the recording sheets can be supplied through the manual sheet inserting slit. Furthermore, the sheet feeding tray can be opened by swinging it about the sheet feeding part, and therefore the sheet is scarcely bent when supplied into the printer; that is, it can be supplied smoothly.

While preferred embodiments of the invention have been described, it will be obvious to those skilled in the art that various changes and modifications may be made thereto without departing from the invention, and it is aimed, therefore, to cover in the appended claim all such changes and modifications as fall within the true spirit and scope of the invention.

What is claimed is:

1. A compact printer comprising:

a printer body including an upper surface, a bottom surface, a rear end face and a sheet discharging outlet;

the intersection of said upper surface and said rear end face defining a first edge, the intersection of said bottom surface and said rear end face defining a second edge;

said sheet discharging outlet being near said first edge;

a stand and stack member rotatably and slidably mounted on said rear end face of said printer body so as to be selectively positioned relative to said rear end face, said stand and stack member being positionable in at least two positions, a stack position at which at least a portion of said stand and stack member projects beyond said first edge for receiving a recording sheet discharged through said sheet discharging outlet, and a first standing position wherein at least a part of said stand and stack member projects beyond one of said first and second edges for stabilizing said printer body when said printer body is positioned in an upright position at which said rear end face faces downwardly.

2. The compact printer as claimed in claim 1, wherein said stand and stack member is selectively positionable at a third position, a storage position at which said stand and stack member essentially does not project beyond said first and second edges, said rear end face of said printer body being formed with a recess for receiving said stand and stack member.

3. The compact printer as claimed in claim 2, including at least one dowel pin for securing said stand and stack member in said storage position.

4. The compact printer as claimed in claim 1, wherein said stand and stack member is a board, said board being formed with an elongated hole, and wherein said rear end face is formed with a projecting supporting stud integral therewith, said board being rotatable and slidable with respect to said stud.

5. The compact printer as claimed in claim 4, including a sheet feeding tray for accommodating a plurality of recording sheets, said sheet feeding tray having a bottom surface, said bottom surface of said printer body and said bottom surface of said sheet feeding tray together at least in part defining the bottom surface of the compact printer, said sheet feeding tray being mounted for displacement at least in part in a direction away and toward said bottom surface of said printer body to open and closed positions, respectively.

6. The compact printer as claimed in claim 5, including a shaft and a sheet feeding roller supported by said shaft, said sheet feeding tray being pivotably coupled to said shaft of said sheet feeding roller so as to permit said sheet feeding tray to be pivotably displaced between said open and closed positions.

7. The compact printer as claimed in claim 5, wherein said stand and stack member is positionable in a second standing position at which at least a portion of said stand and stack member projects beyond the other of said first and second edges for stabilizing said printer body when said printer body is in said upright position with said rear end face facing downwardly.

8. The compact printer as claimed in claim 7, including a manual sheet inserting slit defined between said bottom surface of said sheet feeding tray and said bottom surface of said printer body, said manual sheet inserting slit being constructed so as to allow a recording sheet to be inserted therein when said sheet feeding tray is in said closed position.

9. The compact printer as claimed in claim 1, wherein said rear end face of said printer body is formed with an inclining recess, said stand and stack member being formed with an end located in said inclining recess when said stand and stack member is in said stack position to hold said stand and stack member inclined.

10. The compact printer as claimed in claim 1, including a sheet feeding tray for accommodating a plurality of recording sheets, said sheet feeding tray having a bottom surface, said bottom surface of said printer body and said bottom surface of said sheet feeding tray together at least in part defining the bottom surface of the compact printer, said sheet feeding tray being mounted for displacement at least in part in a direction away and toward said bottom surface of said printer body to open and closed positions, respectively.

11. The compact printer as claimed in claim 10, including a shaft and a sheet feeding roller supported by said shaft, said sheet feeding tray being pivotably coupled to said shaft of said sheet feeding roller so as to permit said sheet feeding tray to be pivotably displaced between said open and closed positions.

12. The compact printer as claimed in claim 10, wherein said stand and stack member is positionable in a second standing position at which at least a portion of said stand and stack member projects beyond the other of said first and second edges for stabilizing said printer body when said printer body is in said upright position with said rear end face facing downwardly.

13. The compact printer as claimed in claim 12, including a manual sheet inserting slit defined between said bottom surface of said sheet feeding tray and said bottom surface of said printer body, said manual sheet inserting slit being constructed so as to allow a recording sheet to be inserted therein when said sheet feeding tray is in said closed position.

14. The compact printer as claimed in claim 10, including a manual sheet inserting slit defined between said bottom surface of said sheet feeding tray and said bottom surface of said printer body, said manual sheet inserting slit being constructed so as to allow a recording sheet to be inserted therein when said sheet feeding tray is in said closed position.

* * * * *